US008581509B2

(12) United States Patent
Cheng et al.

(10) Patent No.: US 8,581,509 B2
(45) Date of Patent: Nov. 12, 2013

(54) DRIVING CIRCUIT HAVING A POWER FACTOR CORRECTION (PFC) FUNCTION

(75) Inventors: Hsin-Hui Cheng, Zhonghe (TW); Claud Gan, Xinzhuang (TW)

(73) Assignee: U-Tel Technology Co., Ltd., Taipei County (TW)

( * ) Notice: Subject to any disclaimer, the term of this patent is extended or adjusted under 35 U.S.C. 154(b) by 362 days.

(21) Appl. No.: 12/959,129

(22) Filed: Dec. 2, 2010

(65) Prior Publication Data

US 2012/0139447 A1 Jun. 7, 2012

(51) Int. Cl.
*G05F 1/00* (2006.01)

(52) U.S. Cl.
USPC ..... 315/291; 315/307

(58) Field of Classification Search
USPC ..... 315/291–308, 224, 209 R
See application file for complete search history.

(56) References Cited

U.S. PATENT DOCUMENTS

| | | | | |
|---|---|---|---|---|
| 6,888,529 | B2 * | 5/2005 | Bruning et al. | 345/102 |
| 7,038,399 | B2 * | 5/2006 | Lys et al. | 315/291 |
| 7,564,198 | B2 * | 7/2009 | Yamamoto et al. | 315/307 |
| 8,247,986 | B2 * | 8/2012 | Su et al. | 315/247 |
| 2008/0278092 | A1 * | 11/2008 | Lys et al. | 315/247 |
| 2010/0213858 | A1 * | 8/2010 | Kuroki et al. | 315/210 |

* cited by examiner

*Primary Examiner* — Douglas W Owens
*Assistant Examiner* — Amy Yang

(57) ABSTRACT

A driving circuit having a power factor correction (PFC) function includes a power converter, a harmonic wave generator, a voltage divider, and a modify element. The power converter receives AC power to convert to DC power. The harmonic wave generator generates a harmonic wave from the DC power. The voltage level of the harmonic wave is decreased by the voltage divider to generate a comparing signal. The modify element compares the comparing signal and a feedback current signal of the LED to regulate the DC power accordingly for power-supplying the LED stably. Therefore the power factor (PF) of the driving circuit is enhanced.

3 Claims, 3 Drawing Sheets

DRIVING CIRCUIT HAVING A POWER FACTOR CORRECTION (PFC) FUNCTION

BACKGROUND OF THE INVENTION

1. Field of the Invention

The present invention relates to a driving circuit, and more particularly but not by any way of limitation, to a driving circuit having a passive-type power factor correction (PFC) function, utilized in illuminating element, especially in LED (light emitting diode).

2. Related Art

The power factor of an AC electric power system is defined as the ratio of the real power flowing to the load to the apparent power and is a dimensionless number between 0 and 1 (frequently expressed as a percentage, e.g. 0.5 pf=50% pf). Real power is the capacity of the circuit for performing work in a particular time. Apparent power is the product of the current and voltage of the circuit. Due to energy stored in the load and returned to the source, or due to a non-linear load that distorts the wave shape of the current drawn from the source, the apparent power will be greater than the real power.

Through the environment/economization policies driven by the governments around the world, LED is well-developed and applied to two major applications including display and illumination functions. Due to plenty of nonstop technology advancements, the conventional single-color LED is gradually unable to satisfy human's visual needs. Consequently, advanced LED products such as bicolor LED and full-color LED are developed afterwards.

With the push toward more efficient energy usage, lower carbon footprints and resource sustainability gaining momentum throughout the world, virtually every aspect of energy generation and consumption is coming under intense scrutiny for improvement Much of the media buzz has centered upon such "big picture" sweeping changes as smart power grids, wind and solar power, carbon sequestration, etc. Reducing energy consumption and increasing energy efficiency are among the European Union's main goals. At the end of 2008, the European Parliament and European Council wrote into EU law three ambitious targets for 2020: cutting greenhouse gases by 20% (30% if international agreement is reached), supplying 20% of energy from renewable sources, and reducing energy consumption by 20% through energy efficiency. Therefore, how to enhance the power factor (PF) of LED is an important issue.

SUMMARY OF THE INVENTION

To solve the aforementioned problems of the prior art, the present invention provides a driving circuit which comply related standards of energy efficiency for LED device. Also, the operation efficiency of the LED device is improved.

Accordingly, the present invention discloses a driving circuit having a power factor correction (PFC) function, utilized in illuminating element, especially in LED (light emitting diode). The driving circuit includes a power converter, a harmonic wave generator, a voltage divider, and a modify element. The power converter receives AC power to convert to DC power. The harmonic wave generator generates a harmonic wave from the DC power. The voltage level of the harmonic wave is decreased by the voltage divider to generate a comparing signal. The modify element compares the comparing signal and a feedback current signal of the LED to regulate the DC power accordingly for power-supplying the LED stably. Therefore the power factor (PF) of the driving circuit is enhanced.

Moreover, the driving circuit of the present invention has a passive power factor correction (PFC) function, to simplify the structure of the circuit and the electric elements to reduce the production cost and meet the requirement of the power factor correction (PFC).

These and other features, aspects, and advantages of the present invention will become better understood with reference to the following description and appended claims. It is to be understood that both the foregoing general description and the following detailed description are examples, and are intended to provide further explanation of the invention as claimed.

BRIEF DESCRIPTION OF THE DRAWINGS

The present invention will become more fully understood from the detailed description given herein for illustration only, and thus is not limitative of the present invention, and wherein.

DETAILED DESCRIPTION OF THE INVENTION

Figure 1:
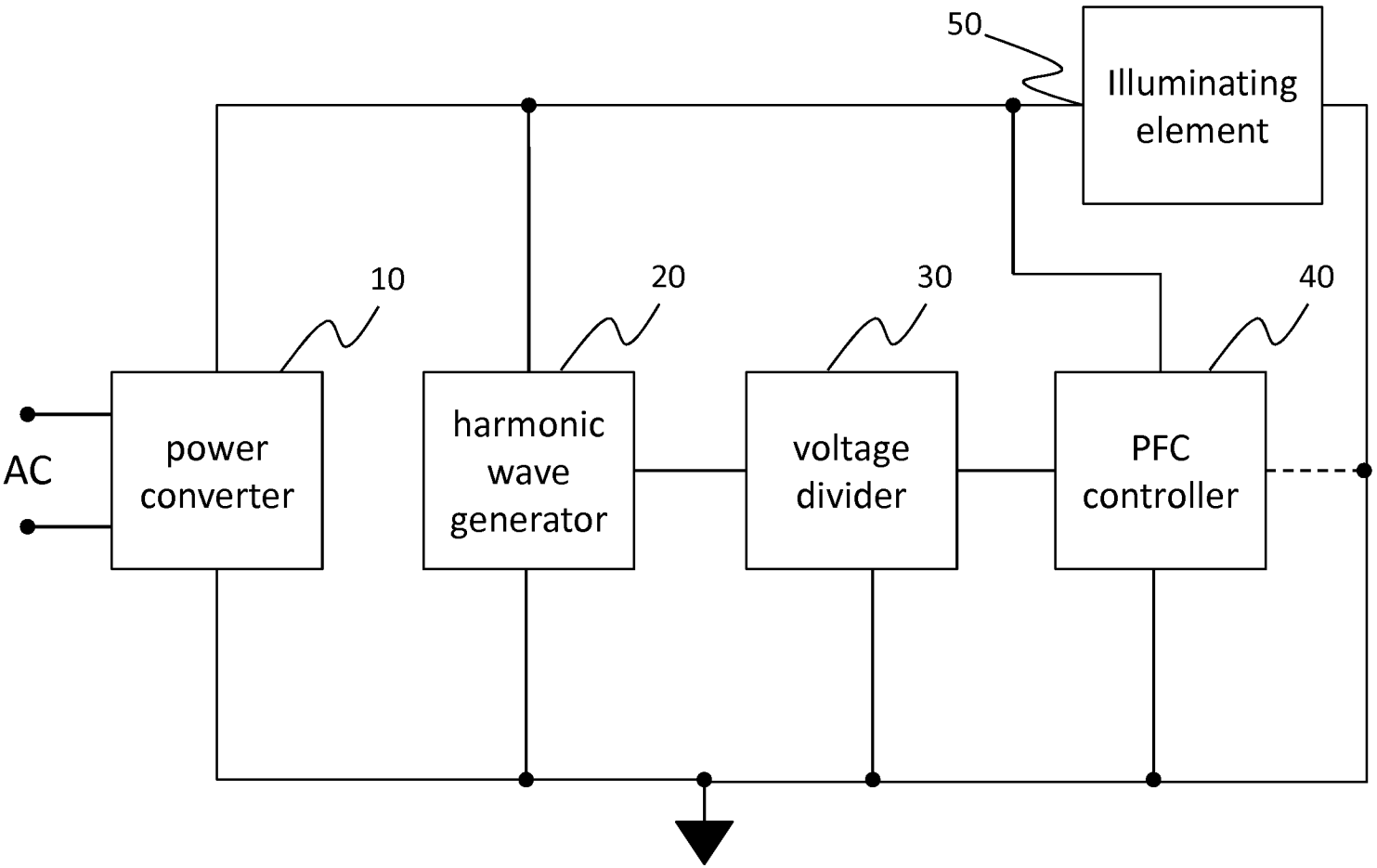
FIG. 1 is a system block-diagram showing the driving circuit in accordance with the present invention.

Reference will now be made in detail to the present preferred embodiments of the invention, examples of which are illustrated in the accompanying drawings. Wherever possible, the same reference numbers are used in the drawings and the description refers to the same or the like parts.

Please refer to FIG. 1, which is a system block-diagram showing the driving circuit in accordance with the present invention.

The present invention discloses a driving circuit having a power factor correction (PFC) function, utilized in illuminating element, especially in LED (light emitting diode). The driving circuit includes a power converter 10, a harmonic wave generator 20, a voltage divider 30, and a modify element 40. The power converter 10 receives AC power and converts to DC power. The harmonic wave generator 20 generates a harmonic wave from the DC power. The voltage level of the harmonic wave is decreased by the voltage divider 30 to generate a comparing signal. The modify element 40 compares the comparing signal and a feedback current signal of the load, i.e. illuminating element 50, to regulate the DC power accordingly for power-supplying the LED, i.e. illuminating element 50, stably. Therefore the power factor (PF) of the driving circuit is enhanced. And the DC power is transmitted to supply load, i.e. illuminating element 50, to operation.

Figure 2:
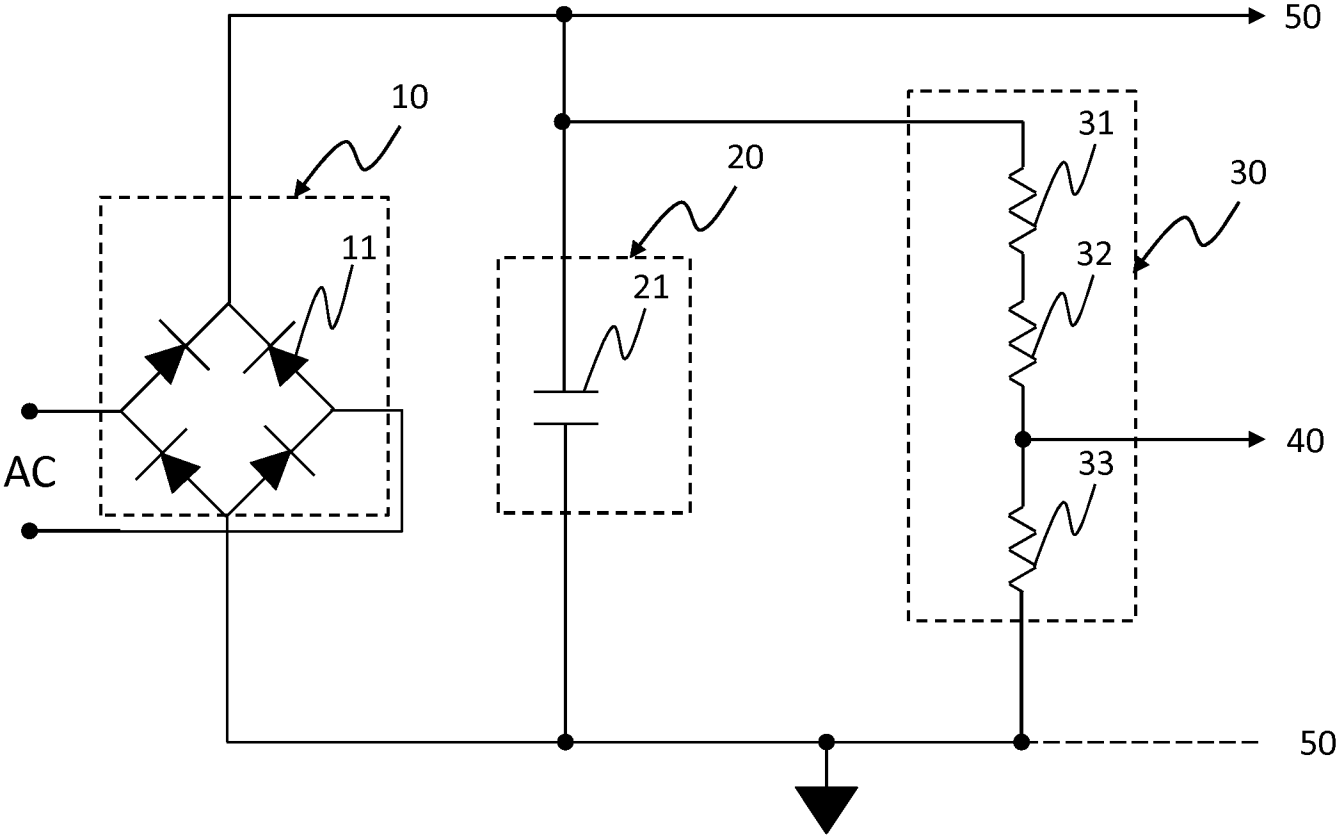
FIG. 2 is the circuit schematic of the driving circuit illustrating first-part of the present invention.

Please see FIG. 2, which is the circuit schematic of the driving circuit illustrating first-part of the present invention, showing the power converter 10, the harmonic wave generator 20, and the voltage divider 30.

The power converter 10 receives the AC power, which may be the mains electricity, such 110V, 240V, 415V, etc. The power converter 10 includes a plurality of diode elements 11 to convert the AC power to the DC power. Because the AC power is unstable, the DC power regulated from the AC power would variable accordingly. The harmonic wave generator 20 is coupled to the power converter 10 and receives the DC power from the power converter 10. The capacitor element 21 of the harmonic wave generator 20 could charge-discharge periodically. The harmonic wave generator 20 perform signal acquisition and generates a harmonic wave. The voltage divider 30 is coupled to the harmonic wave generator 20 and receives the harmonic wave. After receiving, the voltage divider 30 modifies the harmonic wave to a comparing signal to comply the input voltage level of modify element 40. As shown in FIG. 2, the voltage divider 30 includes a plurality of resistor elements, a first resistor 31, a second resistor 32 and a third resistor 33. The first resistor 31 is connected to the second resistor 32 in serial. And the first resistor 31 and the second resistor 32 are connected to the third resistor 33 in parallel. By different resistances of the first resistor 31, the second resistor 32 and the third resistor 33, it is easy to generate the comparing signal (low level) from the harmonic wave to comply the input voltage level of modify element 40 by decreasing the voltage level of the harmonic wave (high level) to avoid damaging the modify element 40 caused by high level voltage.

Figure 3:
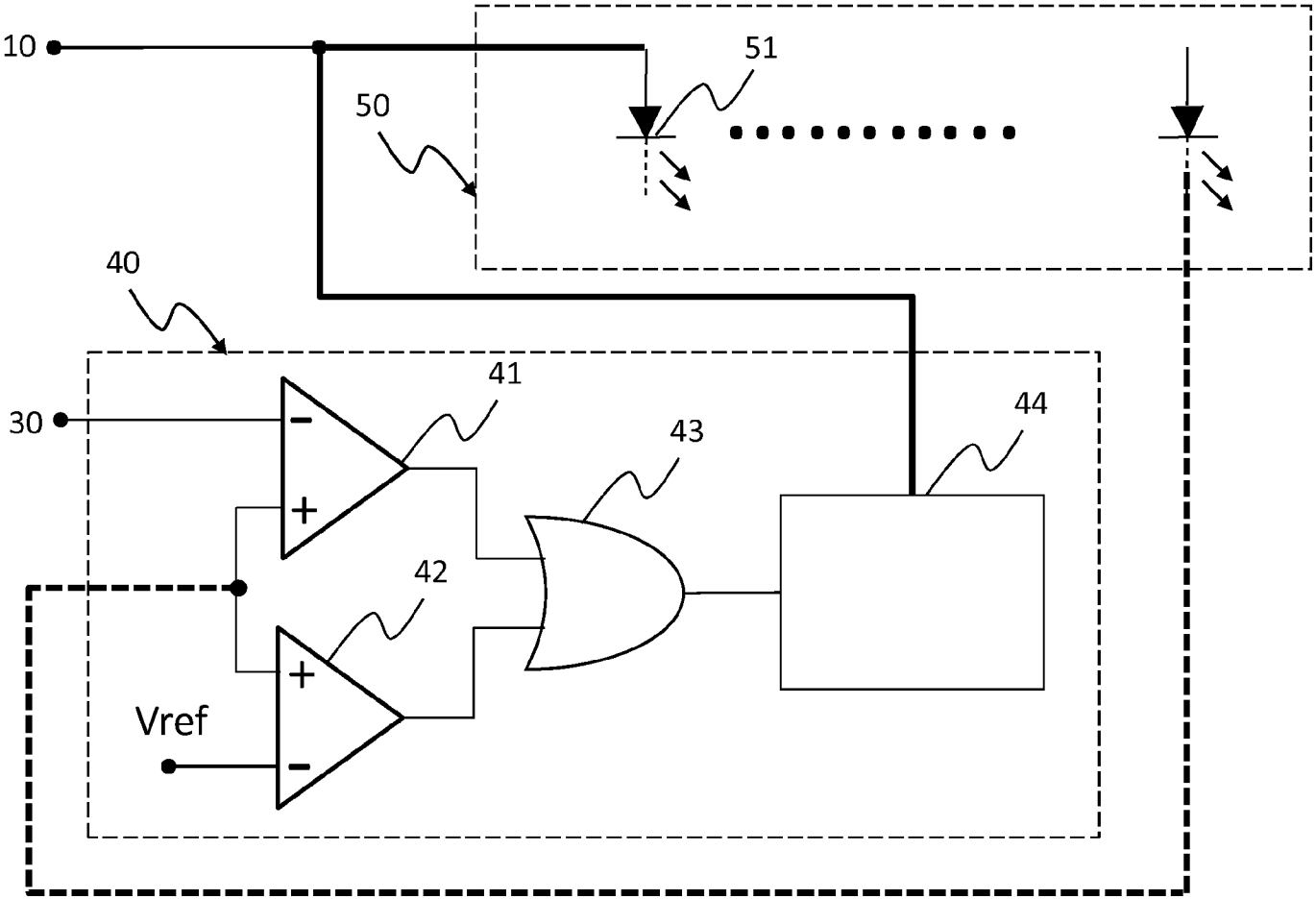
FIG. 3 is the circuit schematic of the driving circuit illustrating second-part of the present invention.

As shown in FIG. 3, which is the circuit schematic of the driving circuit illustrating second-part of the present invention, showing the modify element 40.

The modify element 40 is coupled to the voltage divider 30 and the load, i.e. illuminating element 50. When the modify element 40 receives the harmonic wave, the harmonic wave is compared with a feedback current signal of the illuminating element 50. As shown in FIG. 3, the modify element 40 includes a first comparator 41, a second comparator 42, an OR gate 43, and a duty-cycle controller 44. The first comparator 41 receives the harmonic wave and the feedback current signal to execute a first comparison operation, i.e. to compare the harmonic wave and the feedback current signal. The second comparator 42 receives the feedback current signal and an internal working voltage Vref to execute a second comparison operation, i.e. to compare the feedback current signal and the internal working voltage Vref, which is working voltage of the modify element 40 during operating. The OR gate 43 is coupled to the first comparator 41 and the second comparator 42, and generate a modify signal according the first comparison operation and the second comparison operation, such as Hi or Lo. The duty-cycle controller 44 is coupled to the OR gate 43 and regulates the DC power according to the modify signal. The regulated DC power would be transmitted to supply the illuminating element 50 to enhance the power factor of the driving circuit.

The illuminating element 50 may includes at least one LED (light emitting diode) 51. According to the present invention, the driving circuit utilizes the comparing signal, which is an acquisition signal from the harmonic wave, to compare with the feedback current signal for regulating the working power of the illuminating element, such as LED. The structure of this driving circuit is similar to a passive power factor correction (PFC) circuit. Therefore, the structure of this driving circuit is simple and the obvious advantage is saved cost. The electric elements are simplified to reduce and the production cost and meet the requirement of the power factor correction (PFC), and protect the illuminating element.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A driving circuit having a power factor correction (PFC) function, adapted to drive a LED (light emitting diode), the driving circuit comprising:

a power converter, receiving AC power and to convert the AC power to DC power;

a harmonic wave generator, coupled to the power converter and to generate a harmonic wave from the DC power;

a voltage divider, coupled to the harmonic wave generator and decreasing a voltage level of the harmonic wave to generate a comparing signal; and a modify element, coupled to the voltage divider and receiving the compare signal to compare with a feedback current signal of the LED and regulate the DC power accordingly for power-supplying the LED stably;

wherein the modify element comprises:

a first comparator, receiving the harmonic wave and the feedback current signal to execute a first comparison operation;

a second comparator, receiving the feedback current signal and an internal working voltage to execute a second comparison operation;

an OR gate, coupled to the first comparator and the second comparator, and generate a modify signal according the first comparison operation and the second comparison operation; and a duty-cycle controller, coupled to the OR gate and regulating the DC power according to the modify signal.

2. The driving circuit of claim 1, wherein the harmonic wave generator includes at least one capacitor.

3. The driving circuit of claim 1, wherein the voltage divider includes a plurality of resistors.

* * * * *